United States Patent [19]

Meade et al.

[11] Patent Number: 4,845,650

[45] Date of Patent: Jul. 4, 1989

[54] TICKET ISSUING SYSTEMS

[75] Inventors: Roger Meade, Newark; Paul Schofield, Heatherside; Michael C. Wright, Harrow, all of England

[73] Assignee: Almex Control Systems Limited, Middlesex, England

[21] Appl. No.: 81,947

[22] Filed: Aug. 5, 1987

[30] Foreign Application Priority Data

Aug. 6, 1986 [GB] United Kingdom ..... 8619187

[51] Int. Cl.[4] ..... G07B 1/00

[52] U.S. Cl. ..... 364/708; 364/709.12; 307/150; 224/269; 224/270; 224/271; 224/241; 224/224; 224/225; 224/226

[58] Field of Search ..... 224/269, 270, 271, 241, 224/224, 225, 226; 364/709, 708; 307/150

[56] References Cited

U.S. PATENT DOCUMENTS 2,130,262 9/1958 Burlin ..... 224/267
3,555,394 8/1968 Bramer ..... 357/150

FOREIGN PATENT DOCUMENTS 219580 7/1924 United Kingdom ..... 224/269
0860865 2/1961 United Kingdom .
1547984 7/1979 United Kingdom .
1553570 10/1979 United Kingdom .
0057080 8/1982 United Kingdom .
2140952 12/1984 United Kingdom .

*Primary Examiner*—Andrew J. James
*Assistant Examiner*—David Soltz
*Attorney, Agent, or Firm*—Panitch, Schwarze Jacobs and Nadel

[57] ABSTRACT

A portable ticket issuing system comprises a portable electric ticket issuing machine including a keyboard and electric power means for supplying power to the ticket issuing machine, in which the power means comprises a battery unit having a battery casing separate from the ticket issuing machine casing, and including a flexible cable means for electrically connecting the battery and ticket issuing machine, and including a belt support means for mounting the battery and its casing on an operator away from his front and without the operator holding it manually and further support means for mounting the ticket issuing machine on the operator away from his front in a non-operating position where it is located at the operator's side resting on his thigh and so that it allows the ticket issuing machine to be readily moved to an operating position in front of the operator without moving the battery unit and preferably without detaching it from the belt.

9 Claims, 5 Drawing Sheets

TICKET ISSUING SYSTEMS

BACKGROUND OF THE INVENTION

This invention has reference to ticket issuing machines and has particular but not exclusive reference to ticket machines known as hand held ticket issuing machines which are used to issue tickets for travel by public transport more especially by omnibus or by railway. Such ticket issuing machines may however be used for other applications in which a ticket issuing machine is carried by a mobile operator e.g. for issuing parking offence tickets or bills or betting tickets. It has been known for many years to provide ticket issuing machines comprising various kinds of variations of a printing drum associated with print wheel mechanisms to enable variable information to be printed on the ticket and in which the print wheel mechanism was present to determine the data to be printed on the ticket. Such machines were carried for example by a conductor on board an omnibus. The ticket issuing maching had a supporting web attached to it so that the conductor could support the machine on his chest. The variable data to be printed on the ticket could relate to the kind of ticket (single, return period); the fare stage (either the stage of boarding or the stage at which the passenger was required to alight), the value of the ticket issued etc. In addition static information was printed on the ticket and this information might refer to the issuing authority and the sequence of the ticket and perhaps the date of issue of the ticket.

In addition the ticket machines included registers to enable accumulative information such as the total number of tickets or the total value of tickets issued during a predetermined period to be displayed. Such registers usually showed an accumulative number which was checked as the conductor was issued with the ticket issuing machine at the start of a duty period and was rechecked at the end of the duty period.

Also some portable ticket issuing machines were provided to issue preprinted tickets of predetermined denominations. Thus a series of webs of tickets were arranged in a machine each web being printed in a distinctive colour and each representing a certain ticket value. On depression of a selected lever a single ticket of a predetermined value (dpending upon which lever was depressed) was issued. The machine also included counter mechanisms to indicate the number of tickets of each value issued and the machine had a supporting web to enable the machine to be supported on the conductors chest.

In the specifications of British Patents No: 1553570 and 1547984 there is described a Ticket Issuing Machine for issuing tickets for totalizator betting applications and this machine includes a wire printer mechanism as well as a keyboard, a microprocessor and a matrix display. Information about bets laid etc. were recorded on a computer usually located at a distance from but connected to the individual ticket issuing machines. Such machines were not readily portable.

In the Specification of European Patent Application No: 82300282.9 (0057080) there is described a ticket issuing machine for transport undertaking and which comprises a ticket printing device, a paper feed device for feeding a ticket web past the printing device, a microprocessor means, a keyboard for entering data into the microprocessor means, a store for retaining information about information to be printed on a ticket, which information can be transferred to the microprocessor means to control the ticket printing device under the control of the microprocessor means to determine the information to be printed on the ticket web, and a display panel for displaying information to be entered on the keyboard and information to be printed on the ticket and power means for driving the parts of the ticket issuing machine. This ticket issuing machine was intended primarily for "one man bus" applications. Such machines were not readily portable.

Ticket issuing machines which include a micro processor or other integrated store and control circuits and an electrically controlled printer need a considerable power supply for example a 24 volt battery and this with the casing weighs at least 900 grams.

If the ticket issuing machine is to be portable the battery needs to be carried. The ticket issuing machine is most easily operated when in front of an operator and at a lower level than his chest. However, this is not a convenient position in which to carry the machine when not actually being operated

SUMMARY OF THE INVENTION

An object of the present invention is to provide a ticket issuing machine which is capable of being readily portable so that it may be carried by a conductor or inspector aboard transport undertakings or an operator concerned in the issuing of betting tickets at racecourses or issuing of tickets (including bills, receipts or the like) by Police, Parking Meter Attendants, Gas or Electricity Meter Readers or the like in a relatively convenient carrying position and yet can be readily used in a convenient operating position.

In one aspect, the present invention provides a portable ticket issuing system comprising a portable ticket issuing machine including a keyboard, integrated store and control circuits and a printer mounted in a casing and capable of issuing tickets carrying information entered via the keyboard, and power means for supplying power to the ticket issuing machine, in which the power means comprises a battery unit having a battery casing, separate from the ticket issuing machine casing and including a flexible cable means for electrically connecting the battery and ticket issuing machine, and including first support means for mounting the battery and the casing on an operator away from his chest and without the operator holding it manually and second support means for mounting the ticket issuing machine on an operator so that it allows the ticket issuing machine to lie adjacent the operator's thigh in a non-operating position and to be readily moved to an operating position in front of the operator without moving the battery unit.

In another aspect the invention provides a portable ticket issuing system comprising a portable ticket issuing machine including a first casing, a battery unit having a separate battery casing, a flexible cable for electrically connecting the battery unit and the ticket issuing machine and a belt designed to be worn by an operator, first support means for suspending the battery unit from the belt and second flexible support means for suspending the ticket issuing machine from the belt in a carrying position away from the operator's front, the second flexible support means allowing the ticket issuing machine to be readily moved from the carrying position to an operative position in front of the operator without moving the battery unit.

This enables the ticket issuing machine and battery to be carried in separate positions with both normally out of the way of the operator at his side or back but allows the operator to readily move the ticket issuing machine to a convenient position for operation without also having to move the battery. The ticket issuing machine without the battery can be made light enough (900 grams) and small enough (250×104×64 mm) for the operator to support it with one hand while operating the keyboard with the other hand. Alternatively, the ticket issuing machine can be supported on a table or other support surface at working height whilst still attached to the battery unit carried by the operator.

Preferably the means supporting the ticket issuing machine is flexible and/or extendible so that the ticket issuing machine can be moved to the operating position without disconnecting it from the support/belt.

BRIEF DESCRIPTION OF THE DRAWINGS

Ticket issuing systems in accordance with the present invention will now be described by way of example with reference to the accompanying drawings wherein.

DETAILED DESCRIPTION OF EMBODIMENTS

Figure 1:
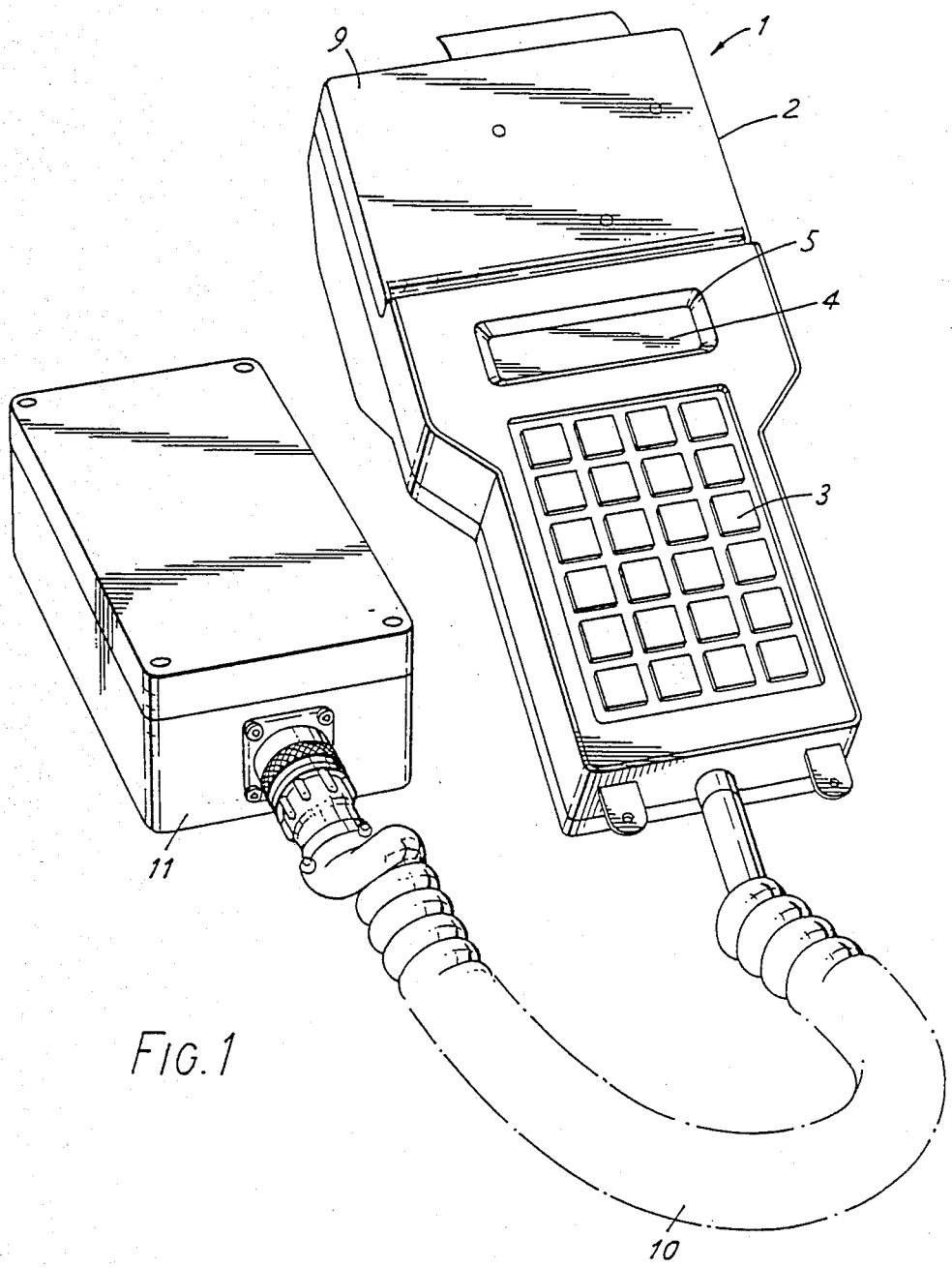
FIG. 1 is a perspective view of the ticket issuing machine, the battery and the connecting lead.

Referring to the drawings FIG. 1 shows a hand held ticket issuing machine 1 including a casing 2 which has a keyboard 3 and a display 4 visible through a window 5 in the casing. The machine embodies integrated store circuits and control circuits (not shown) and these circuits are more fully described in the specification of our copending application for Patent No: (corresponding to G.B. Application No. 8619188). A printer 9 preferably a thermal printer for printing a thermal sensitive paper is provided for printing the tickets.

A flexible connecting lead 10 in the form of a spirally wound and thus elastically extendible cable is connected to the ticket issuing machine from a battery unit 11 comprising batteries 12 in a casing 12A and provides a power connection to drive the ticket issuing machine.

Figure 2:
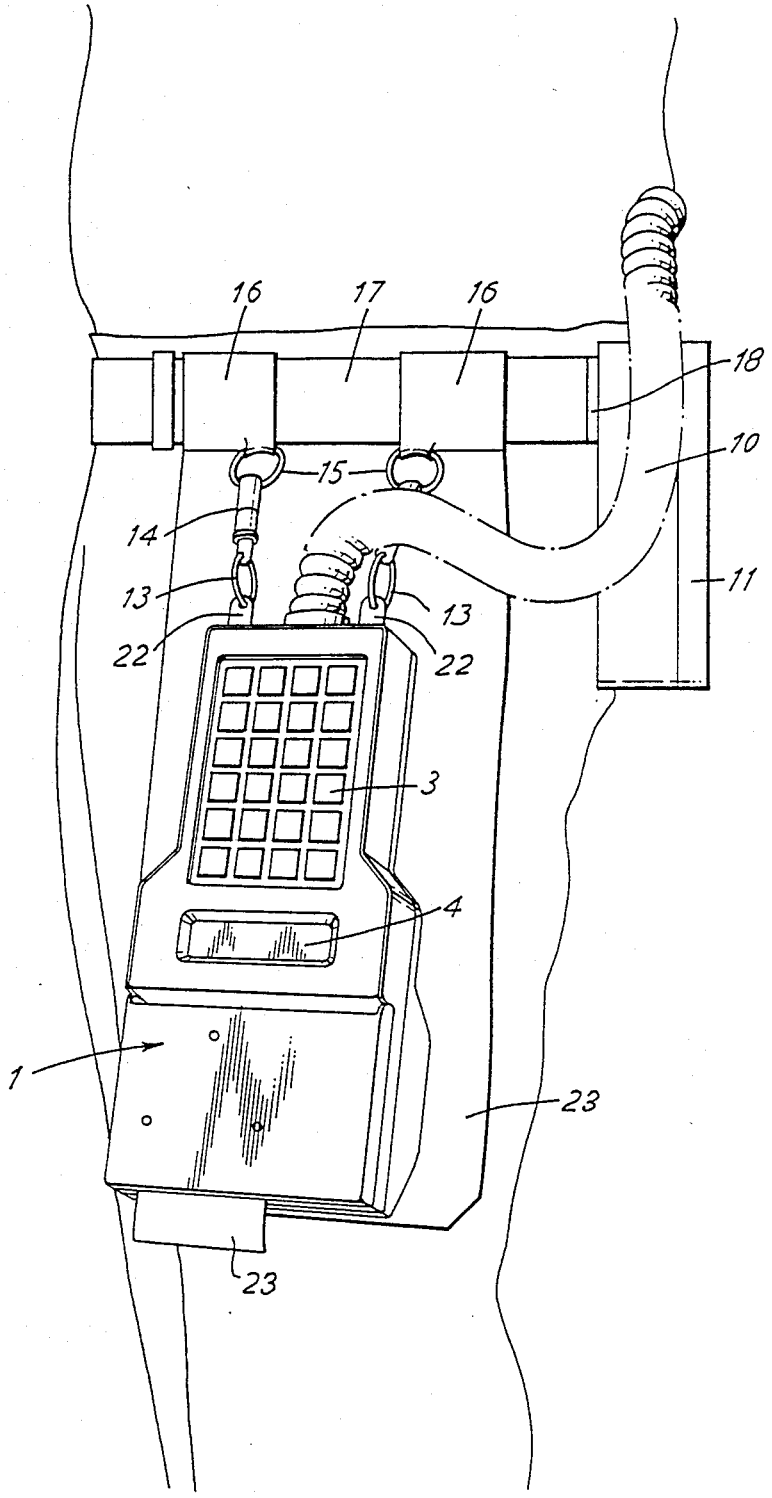
FIG. 2 is a view of the ticket issuing machine and battery supported on the operators belt.

The casing of the ticket issuing machine has a pair of rings 13 secured to a respective bracket 22 on the upper surface of the machine (as shown in FIG. 2) and these rings 13 are disengageably connected by respective links 14 which are respectively supported by rings 15 connected to loops 16 formed of web strips through which the operator's belt 17 is threaded. The web strips and ticket issuing machine are so positioned that the ticket issuing machine hangs at his side supported on the operator's thigh.

The battery 11 unit which supplies power to the ticket issuing machine likewise is supported by a clip(s) or loop(s) 18 which clips on to the operators belt to support the battery adjacent his back.

When the ticket issuing machine is inoperative it hangs from the operator's belt and rests on the operator's thigh. However when the operator requires to issue a ticket he places his hand under the machine to raise it to an operative position in front of him as shown in FIG. 4 to operate the keys of the keyboard and issue the required ticket 23.

Figure 3:
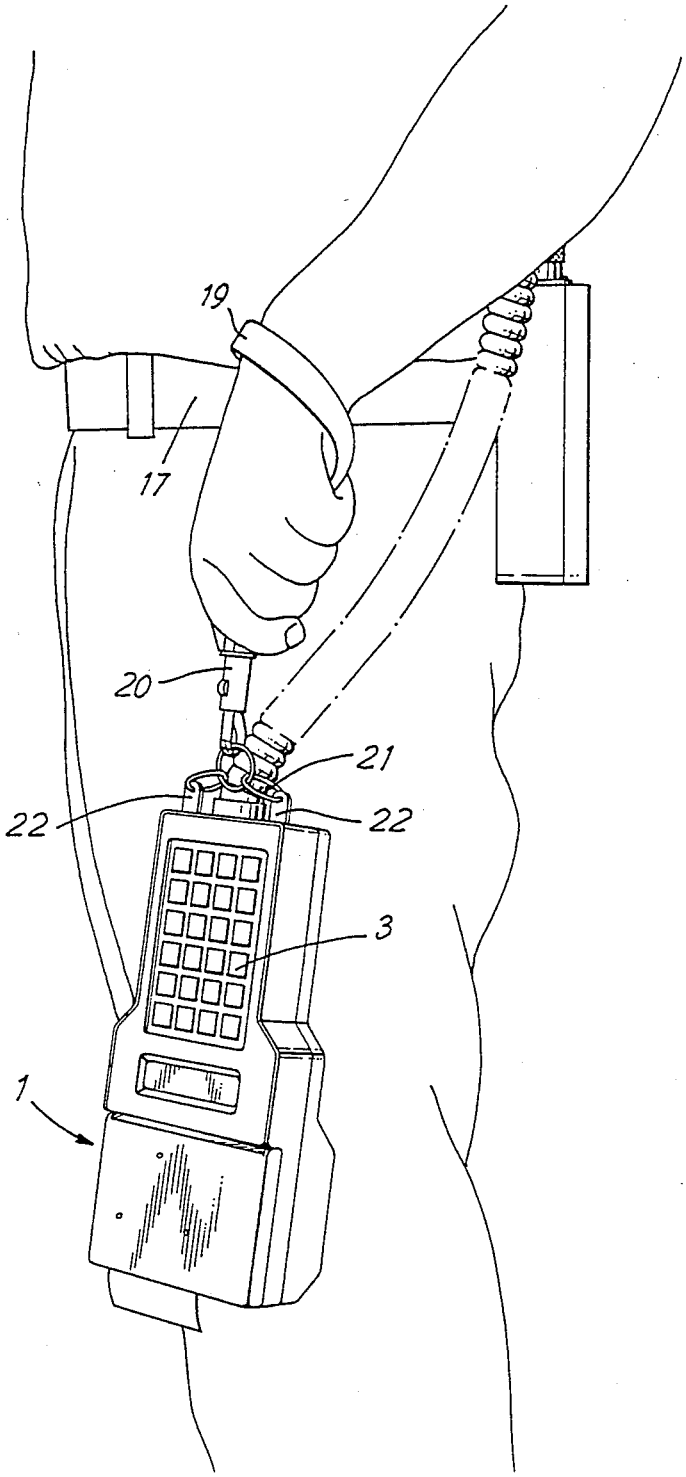
FIG. 3 is a view of the ticket issuing machine including an alternative support for the ticket issuing machine.

In the alternative arrangement shown in FIG. 3 the ticket issuing machine is flexibly supported by a flexible looped web 19 through which the operator's wrist is passed. The flexible looped web is connected to a link 20 and a series of three rings 21 connected to brackets 22 on the ticket issuing machine. The link includes a release means to unclip the link from the rings.

Figure 4:
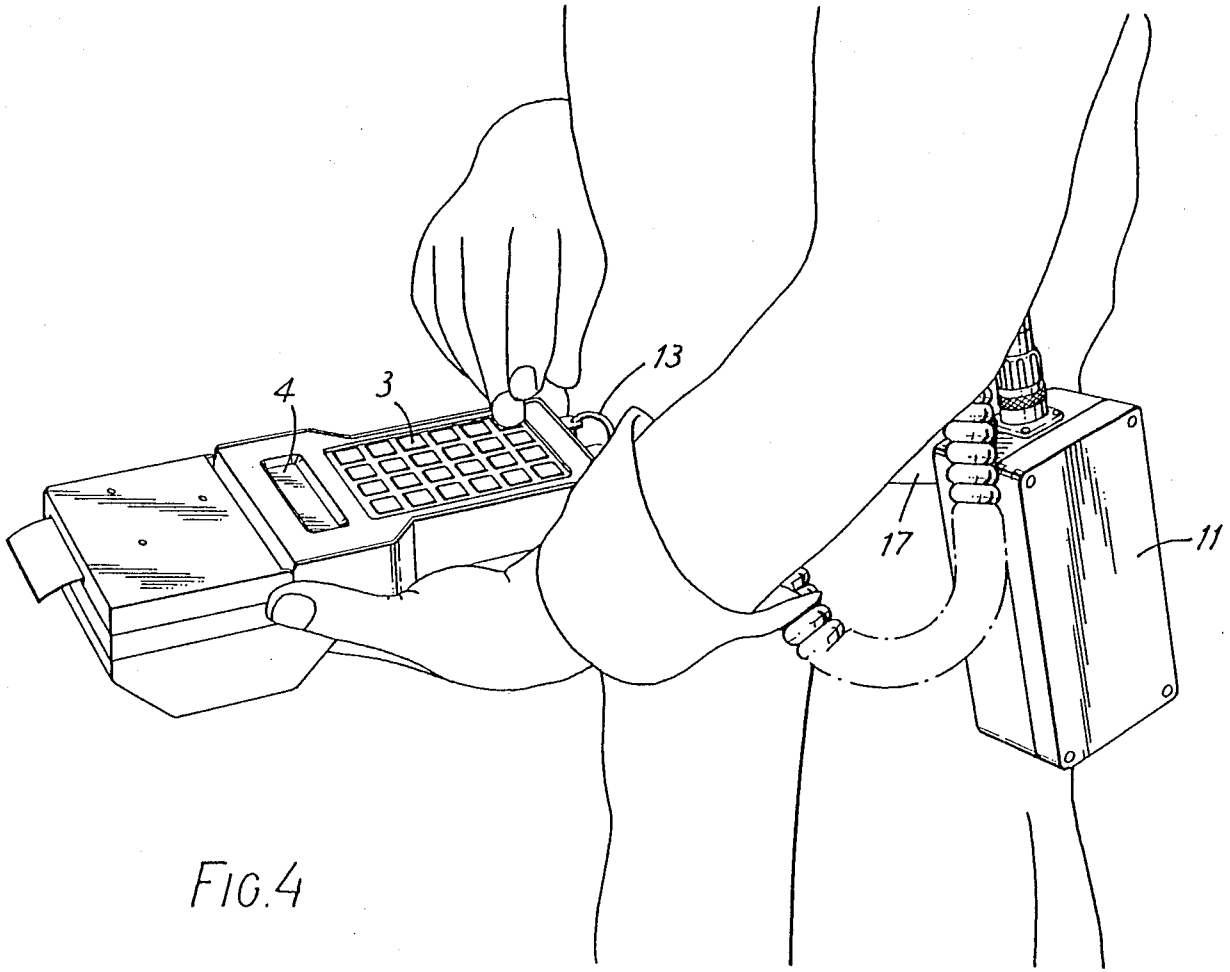
FIG. 4 shows the ticket issuing machine in use.

The ticket issuing machine as shown FIG. 3 operates in a similar manner to that shown in FIG. 2 in that when it is inoperative it hangs on the operator's thigh but when operative as shown in FIG. 4 is raised by the operator's hand to an operating position when a ticket 23 is to be issued.

As shown in FIG. 2 an apron may be carried by the operator's belt 17 to prevent the ticket issuing machine rubbing on the operator's clothes.

Figure 5:
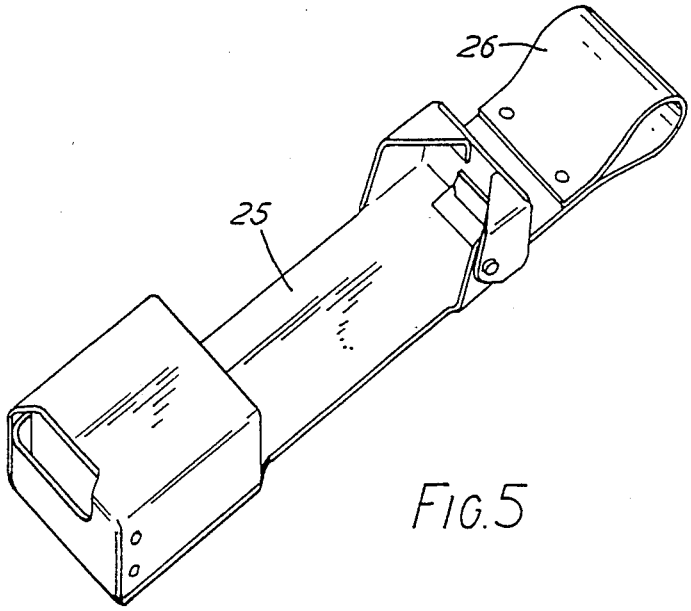
FIG. 5 shows an alternative mounting means for the ticket issuing machine and FIGS. 6 & 7 are rear and side views of a slightly modified battery unit.
Figure 6:
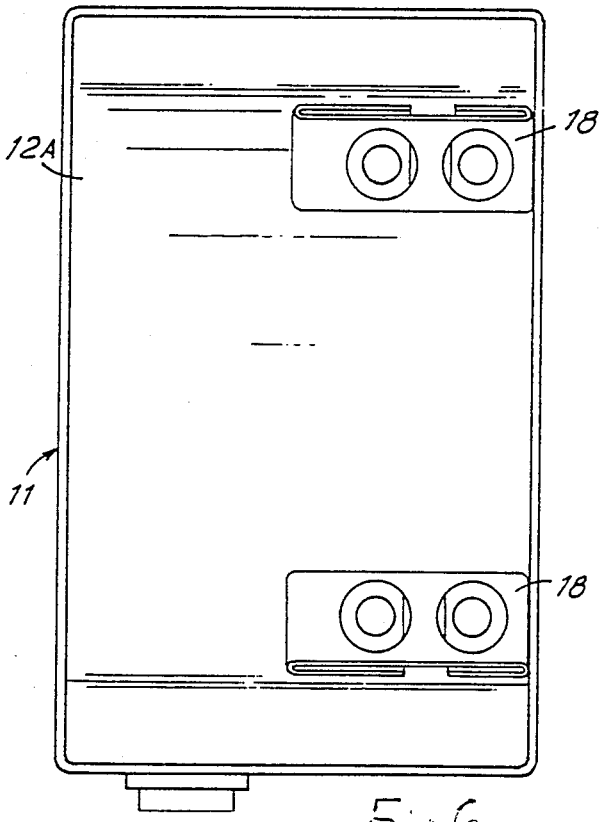
Figure 7:
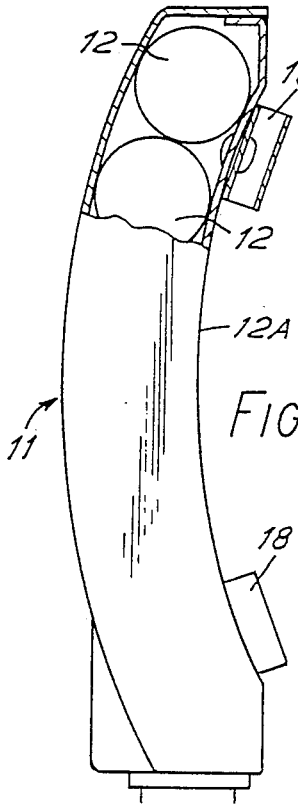

In a further embodiment shown in FIG. 5, a pouch or holster 25 is supportable on the operator's belt by loop 26 and the ticket issuing machine may, when inoperative, be slipped into the pouch and when operative, removed from the pouch supporting means.

What is claimed is:

1. A portable ticket issuing system comprising a portable electric ticket issuing machine including a casing, a printer, a keyboard and electric power means for supplying power to the ticket issuing machine, in which the power means comprises a battery unit having a battery casing separate from the ticket issuing machine casing, and including a flexible cable means for electrically connecting the battery and ticket issuing machine, and including first support means for mounting the battery and its casing on an operator away from his front and without the operator holding it manually and second support means for mounting the ticket issuing machine on an operator away from his front in a non-operating position, the second support means allowing the ticket issuing machine to be readily moved from the non-operating position to an operating position in front of the operator without moving the battery unit.

2. A system according to claim 1 in which in the non operating position the second support means supports the ticket issuing machine adjacent the operator's side resting on his thigh.

3. A system according to claim 1 in which the first and second support means each includes a common belt.

4. A system according to claim 3 in which the first and second support means each include detachable clip means for detachably suspending the battery casing and ticket issuing machine respectively from the belt.

5. A system according to claim 3 in which the second support means is flexible so that the ticket issuing machine can be moved between the non-operating position and the operating position without detaching it from the belt.

6. A belt according to claim 3 in which the second support means comprises a pouch suspended from the belt and designed to hold the ticket issuing machine.

7. A system according to claim 1 in which the second support means is a flexible loop designed to be slung from the operator's wrist.

8. A system according to claim 1 in which the cable is a spirally wound cable.

9. A portable ticket issuing system comprising a portable ticket issuing machine including a first casing, a battery unit including a separate battery casing, a flexible cable for electrically connecting the battery unit and the ticket issuing machine and a belt designed to be worn by an operator, first support means for suspending the battery unit from the belt away from the operator's front and second flexible support means for suspending the ticket issuing machine from the belt in a non operating position away from the operator's front, the second flexible support means allowing the ticket issuing machine to be readily moved from the non-operating position to an operating position in front of the operator without moving the battery unit and without disconnection from the belt.

* * * * *